United States Patent [19]

Williams

[11] Patent Number: 4,665,584

[45] Date of Patent: May 19, 1987

[54] BUOYANT VALVE MEMBER CLOSING DEVICE FOR DOORS

[76] Inventor: Patrick Y. Williams, 22 Compass Way, Tweed Heads, NSW, 2458, Australia

[21] Appl. No.: 870,958

[22] Filed: Jun. 5, 1986

[30] Foreign Application Priority Data

May 29, 1985 [AU] Australia ..... PH0793

[51] Int. Cl.[4] ..... E05F 1/02; E05F 1/08

[52] U.S. Cl. ..... 16/81

[58] Field of Search ..... 16/51, 58, 81, 82, 84; 188/316

[56] References Cited

U.S. PATENT DOCUMENTS

| | | | |
|---|---|---|---|
| 1,037,052 | 8/1912 | Rennie | 16/51 |
| 1,164,371 | 12/1915 | Lovejoy | 16/51 |
| 1,170,226 | 2/1916 | Doxey | 16/51 |
| 1,198,829 | 9/1916 | Edwards | 16/51 |
| 2,735,675 | 11/1956 | Lindsey . | |
| 3,334,444 | 8/1967 | Hargrove | 16/81 |
| 3,605,340 | 9/1971 | Nolan et al. | 49/387 |
| 4,003,102 | 1/1977 | Hawks et al. . | |
| 4,126,912 | 11/1978 | Johnson . | |

FOREIGN PATENT DOCUMENTS

| | | |
|---|---|---|
| 527354 | of 0000 | Australia . |
| 75066 | 3/1983 | Australia . |
| 26756 | 10/1984 | Australia . |
| 1178739 | 9/1964 | Fed. Rep. of Germany . |
| 2263363 | 10/1975 | France . |

*Primary Examiner*—M. Jordan

*Attorney, Agent, or Firm*—Pretty, Schroeder, Brueggemann & Clark

[57] ABSTRACT

A door closing device has an upright tube closed at the bottom and containing a damping liquid, a sinker weight being arranged in the tube and connected to a flexible cord which extends out of the top of the tube for connection to a door so that a door is automatically closed when released, the sinker weight falling under gravity to pull the door closed. The device includes a passage extending through the sinker weight with a valve seat formed at the lower end of the passage and co-operating with a buoyant self-seating valve member (preferably a plastic ball which is not captive relative to the weight) which controls liquid flow through the passage when the weight sinks. As the door is opened, the weight is pulled rapidly upwards and lifts off the buoyant valve member. Preferably, the valve member substantially seals the passage in the weight and there is a clearance around the weight for passage of the damping liquid during closing of the door.

10 Claims, 5 Drawing Figures

BUOYANT VALVE MEMBER CLOSING DEVICE FOR DOORS

FIELD OF THE INVENTION

This invention relates to devices for closing doors and for similar applications.

BACKGROUND TO THE INVENTION

One previous automatic door closing device comprises a weight connected to the door by a flexible cord which is arranged over a pulley system. This arrangement has the disadvantage of closing the door in an accelerating manner; the door usually impacts on the door frame at considerable velocity. Air damped and spring assisted piston-type door closers are also known, but have the disadvantages of not providing a uniform closing speed and requiring frequent bleed valve adjustment to compensate for wear. Furthermore, such door closers require high accuracy in manufacture and expensive engineering is needed for heavy duty applications, such as fire doors.

Examples of prior specifications applicable to door closing devices are as follows:

U.S. Pat. No. 4,003,102 (Hawks et al)
U.S. Pat. No. 2,735,675 (Lindsey)
U.S. Pat. No. 4,126,912 (Johnson)
AU,A specification No. 26756/84 (Brayford)
AU,A specification No. 75066/81 (Driscoll)
AU,B specification No. 527354 (Cassidy)
DE,A specification No. 1178739 (Herman)
FR,A specification No. 2263363 (Gretsch Unitas G.M.B.H.)

The present invention is directed towards providing an apparatus for closing doors or the like which is a new and useful alternative to known arrangements. More particularly it would be desirable to provide a device which could be manufacturered cheaply, be extremely reliable, have low maintenance and operate smoothly.

SUMMARY OF THE INVENTION

The present invention consists in a closing device for a door comprising:

a tube arranged to extend substantially vertically when in use and to contain a damping liquid;

a weight which is movable along the tube and arranged to sink in the liquid;

connecting means for connecting the weight to a door such that the weight is pulled upwardly when the door is opened and when the door is released the weight pulls the door towards a closed position as the weight sinks; and liquid flow control means for permitting the flow of damping liquid from one side of the weight to the other at a relatively slow rate when the weight is released and is sinking to pull the door closed, and at a relatively fast rate when the weight is pulled upwardly as the door is opened, the liquid flow control means comprising a passage extending through the weight with a valve seat formed at one end of the passage which will be at the lower end of the weight when in use, and a buoyant self-seating valve member for engaging with the valve seat to control liquid flow through the passage when the weight sinks, the buoyant valve member being arranged below the weight and being free to be displaced from the valve seat when the weight is pulled upwardly.

The invention could be embodied in a form in which little or no damping liquid can pass between the sides of the weight and the tube; in such an embodiment either a secondary passage of small diameter through the weight would be needed or alternatively the valve member could be arranged not to seal completely on its valve seat as the weight sinks. However, the prefered embodiment of the invention is one in which a small clearance is provided around the weight between the sides of the weight and the tube. This clearance provides the sole or main flow path of the liquid past the weight when it is sinking.

Preferably, the buoyant valve member is a buoyant ball such as a plastic spherical float which, most advantagously, can be in the form of a free floating ball which is not captive relative to the weight.

In a preferred embodiment, the tube is of uniform cross-section through its length and conveniently is an inexpensive aluminium extrusion, which is simply sealed at its lower end with a plug. However, the tube need not be of uniform cross-section. The level of damping fluid can be selected to suit the user's requirements. If fast initial closing is desired, then filling the fluid about half-way up the tube would delay the slow damped closing action until the weight becomes immersed.

A BRIEF DESCRIPTION OF THE DRAWINGS

Further preferred features and advantages will become apparent from the following description of embodiments of the invention which are given with reference to the accompanying illustrative drawings in which.

DETAILED DESCRIPTION OF THE DRAWINGS

Figure 1:
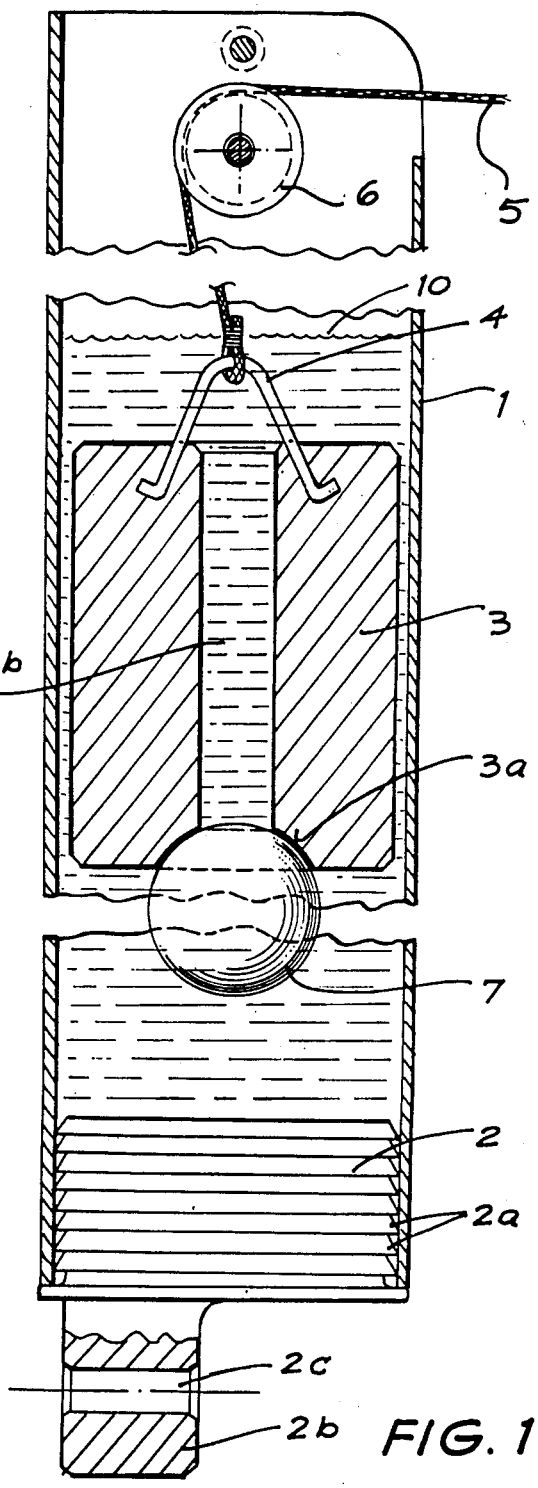
FIG. 1 is a schematic front view of a preferred embodiment.

Referring to FIGS. 1–4, the embodiment is applied to a sliding door and comprises a tube 1, a weight 3 typically of lead, a ball-shaped valve float 7, and a flexible connection cord 5 which extends over a roller 6 near the open top of the tube 1 for connection to a door.

A sealing plug 2 closes the lower end of the tube. The plug 2 has a series of horizontal peripheral ribs **2*a* of generally sawtooth profile and a projecting base 2*b* provided with a cross bore 2*c* for fixing the bottom of the door closer to a structure. The plug is conveniently moulded in synthetic rubber and is push fit in the end of the tube 1**, thereby forming a liquid-tight seal.

The weight 3 is formed by casting in lead, with a suspension loop 4 cast into the weight. The weight is a clearance fit within the tube 1 so that liquid may pass between the weight and the inside of the tube at a uniform slow rate when the weight is allowed to fall within the tube under the influence of gravity. The bottom face of the weight 3 has a part-spherical concave valve seat **3*a* concentric with a central bore 3*b* extending through the weight. The valve float 7 self-seats with the seat 3*a***.

The bore 3*b* has sufficient cross-sectional area to allow rapid flow of liquid through the weight when the weight is lifted by opening the door. Normally the bore 3*b* is sealed from below by the ball 7. However, when the weight is lifted, due to pressure in the liquid column, the ball 7 is no longer seated and the bore opens to permit liquid to pass rapidly through the weight. Thus, there is little resistance to movement of the weight 3 through the liquid. The ball is free to rise in the liquid due to its buoyancy until it once again comes into contact with the valve seat of the weight. usually when the door is opened and stationery.

When the door is released, the weight falls under gravity and the ball establishes a seal on its seat, since the weight is pushing against the ball and the liquid pressure from below is urging the ball against the valve seat. Accordingly, there is uniform damping of the weight as it sinks, liquid flowing through the small clearance between the weight and the inner surface of the tube 1.

The flexible cord 5 is attached to the weight 3 through the loop 4 and extends over a roller 6 fixed at the top end of the tube 1. A pad 8 is provided to wipe liquid from the flexible cord when the door is being opened. The pad 8 is mounted on a cross pin 9 at the top of the tube 1.

The damping liquid conveniently can be water which, ideally, has a small layer of oil on top to prevent evaporation. Alternatively, the liquid may comprise a soluble oil solution. The liquid substantially fills the tube 1, typically to the level 10 shown in FIG. 1.

Figure 2:
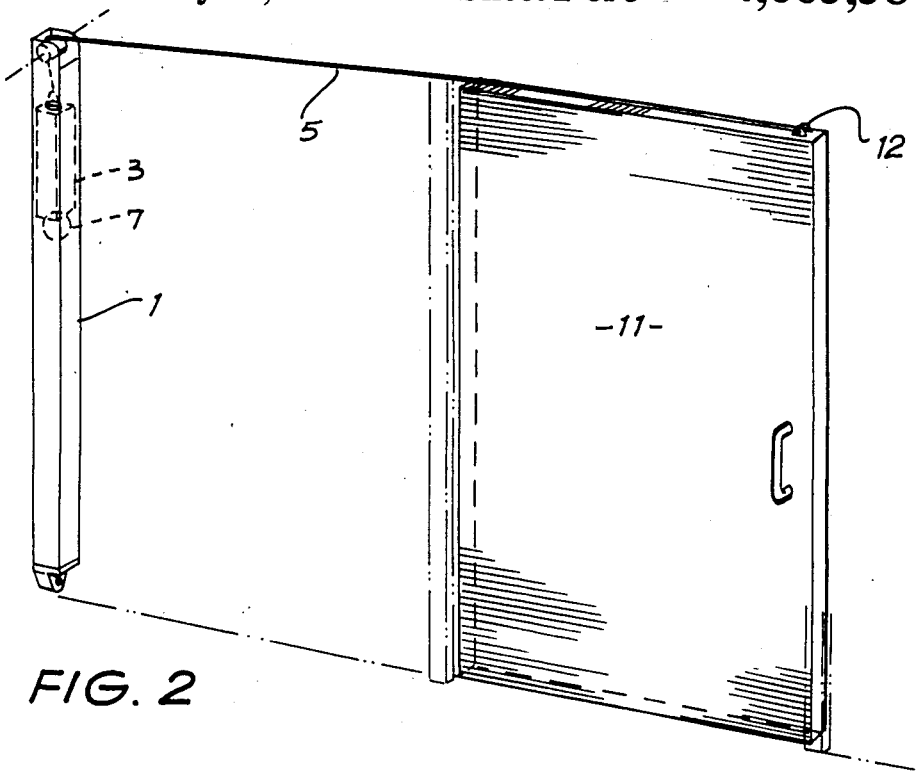
FIG. 2 shows an embodiment connected to a sliding door.
Figure 3:
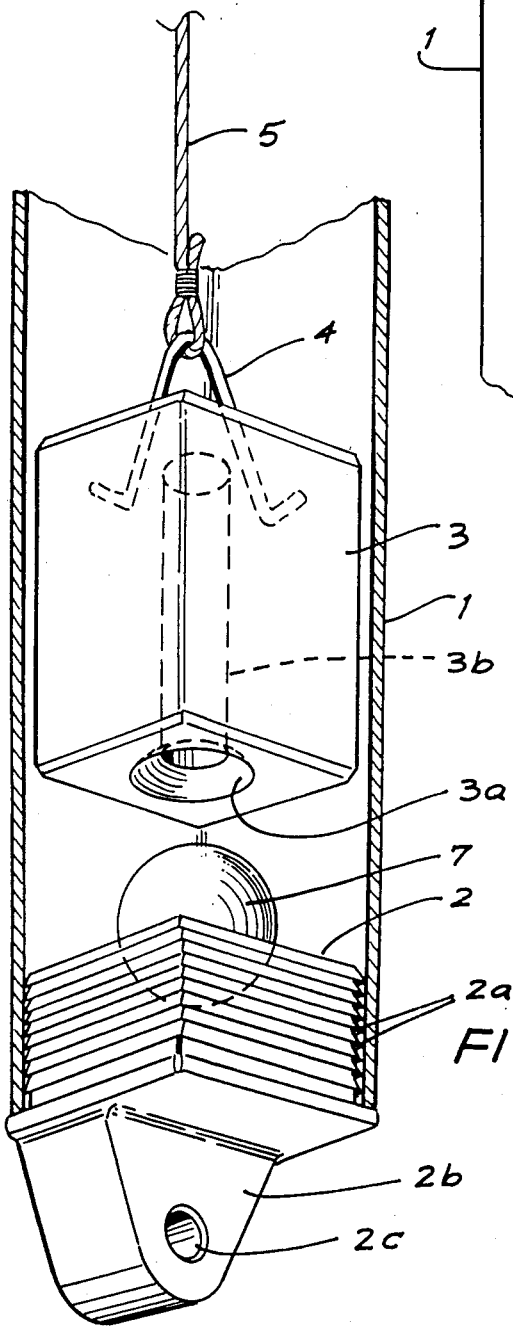
FIG. 3 is a schematic isometric view from below and partially in section of the lower portion of the door closing device of FIG. 1.
Figure 4:
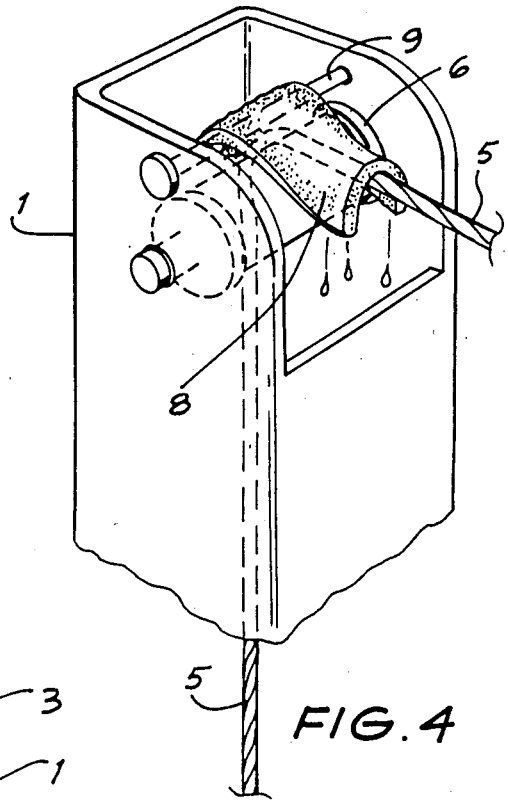
FIG. 4 is a schematic partial isometric view from above showing the top portion of the door closing device in FIG. 1.

FIG. 2 illustrates application of the arrangment of FIGS. 1, 3 and 4 to a sliding door. The drawing illustrates the sliding door 11 in an open position with the connecting cord 5 secured to a bracket 12 on a top portion of the door.

Figure 5:
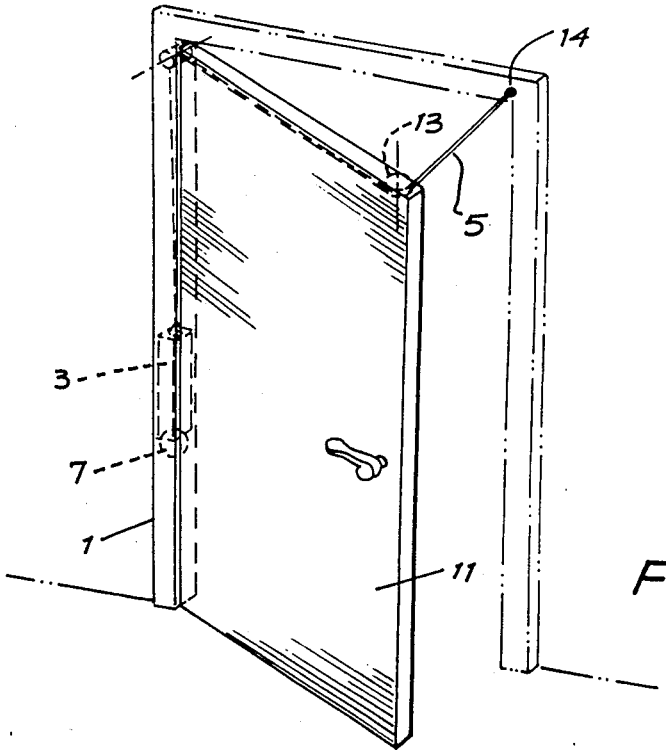
FIG. 5 shows an embodiment connected to hinged door.

FIG. 5 shows a hinged door 11A and in this embodiment the closing device is attached to a door frame adjacent the hinges. In this embodiment, the cord 5 passes around a pulley block 13 mounted on top of the door and extends to a fixing bracket 14 on the door frame.

The door closer of the preferred embodiment has been shown to close the door effectively at a substantially uniform rate regardless of the required distance of travel of the door i.e. the extent to which the door is open when released. As the tolerance of the weight clearance is not a critical factor, many years of use should not affect the operation of the door closure. The simple float ball arrangement has no wearing parts and no valve adjustment should ever be necessary.

One demanding application of door closers is for fire doors; an embodiment of the invention can provide an economic and reliable arrangement for this purpose.

I claim:

1. A closing device for a door comprising:

a tube arranged to extend substantially vertically when in use and to contain a damping liquid;

a weight which is movable along the tube and arranged to sink in the liquid;

connecting means for connecting the weight to a door such that the weight is pulled upwardly when the door is opened and when the door is released the weight pulls the door towards a closed position as the weight sinks; and liquid flow control means for permitting the flow of damping liquid from one side of the weight to the other at a relatively slow rate when the weight is released and is sinking to pull the door closed, and at a relatively fast rate when the weight is pulled upwardly as the door is opened, the liquid flow control means comprising a passage extending through the weight with a valve seat formed at one end of the passage which will be at the lower end of the weight when in use, and a buoyant self-seating valve member for engaging with the valve seat to control liquid flow through the passage when the weight sinks, the buoyant valve member being arranged below the weight and being free to be displaced from the valve seat when the weight is pulled upwardly.

2. A closing device as claimed in claim 1, wherein a small clearance is provided between the walls of the tube and the periphery of the weight, and the valve member substantially closes the passage through the weight to prevent damping liquid flow through the passage as the weight sinks in the tube.

3. A closing device as claimed in claim 1, wherein the buoyant valve member is a buoyant ball.

4. A closing device as claimed in claim 3 wherein, the buoyant ball is a plastic spherical float.

5. A closing device as claimed in claim 1, wherein the buoyant valve member is free floating and is non-captive relative to the weight.

6. A closing device as claimed in claim 1, wherein the tube is a metal tube of uniform cross-section and the lower end of the tube is closed with a sealing plug having an extension to permit the lower portion of the closing device to be secured to a structure.

7. A closing device as claimed in claim 1, wherein the connecting means comprises a flexible wire or cord extending over a roller mounted in the top of the tube for guiding the wire or cord.

8. A closing device as claimed in claim 7, wherein a wiper pad is located near the top of the tube for removing damping liquid from the wire or cord as the weight is raised.

9. A door structure comprising of closing devices claimed in claim 1 and associated with a door frame, and a door connected to the connecting means and arranged to have its closing operation automatically effected by the closing device, the tube of the closing device being substantially filled with a damping liquid.

10. A closing device for a door comprising:

a tube arranged to extend substantially vertically when in use and to contain a damping liquid;

a weight which is movable along the tube and arranged to sink in the liquid;

connecting means for connecting the weight to a door such that the weight is pulled upwardly when the door is opened and when the door is released the weight pulls the door towards a closed position as the weight sinks; the weight having a small clearance within the tube for the passage at a relatively slow rate of damping liquid;

the weight having a bore passing therethrough and of relatively large cross-sectional area for permitting damping liquid to pass from above the weight to below the weight at a relatively fast flow rate;

a valve seat formed on the weight around the lower end of the said bore in the weight;

a buoyant self-seating valve member arranged to float up under the weight and seat on the valve seat for closing said bore, the valve member having a smoothly curved symmetric shape extending around a vertical axis passing through the centre of the valve seat, whereby as the door is opened the weight is pulled upwardly by the connecting means and lifts off the ball to permit flow of damping liquid from above the weight to below the weight with little resistance, and, when the door is released, the weight falls under gravity and when immersed in the damping liquid co-operates with the valve member so that said bore is closed and the weight falls slowly as the damping liquid passes along the clearance between the weight and the surrounding tube.

* * * * *